United States Patent [19]

Klatt et al.

[11] 4,180,370

[45] Dec. 25, 1979

[54] TURBOMOLECULAR PUMP

[75] Inventors: Karl-Heinz Klatt, Jülich; Eckard Kussel, Duren, both of Fed. Rep. of Germany

[73] Assignee: Kernforschungsanlage Jülich Gesellschaft mit beschränkter Haftung, Jülich, Fed. Rep. of Germany

[21] Appl. No.: 861,546

[22] Filed: Dec. 19, 1977

[63] Continuation-in-part of Ser. No. 669,264, Mar. 22, 1976, abandoned.

[30] Foreign Application Priority Data Mar. 22, 1975 [DE] Fed. Rep. of Germany 2512828.

[51] Int. Cl.[2] ..... F01D 1/36

[52] U.S. Cl. ..... 415/90; 415/111

[58] Field of Search ..... 415/90, 112, 180, 110, 415/111; 417/405; 277/80

[56] References Cited

U.S. PATENT DOCUMENTS

| | | | |
|---|---|---|---|
| 3,399,827 | 9/1968 | Schwartzman | 415/90 |
| 3,620,584 | 11/1971 | Rosenweig | 277/80 |
| 3,740,060 | 6/1973 | Miskolczy | 277/80 |
| 3,753,623 | 8/1973 | Wutz | 415/90 |
| 3,969,039 | 7/1976 | Shoulders | 417/405 |
| 3,969,042 | 7/1976 | Bachler | 415/112 |

*Primary Examiner*—Louis J. Casaregola
*Attorney, Agent, or Firm*—Becker & Becker, Inc.

[57] ABSTRACT

A turbomolecular pump employing as drive motor a pressure gas turbine the output shaft of which is drivingly connected to a rotatable shaft journalled to pneumatic bearings and carrying the turbine rotor of the pump which rotor operates with the turbine stator fixedly connected to the pump housing. That part of the rotatable shaft which is remote from the pressure gas turbine passes through a seal including a magnetic sealing fluid which is magnetically held in its sealing position. The pump is furthermore provided with passages communicating with the pneumatic bearing and the seal for cooling the same and the adjacent rotor shaft area. The seal sealingly surrounding the adjacent rotor shaft portion seals this rotor shaft portion relative to the pneumatic bearings and relative to the vacuum chamber of the pump.

4 Claims, 2 Drawing Figures

TURBOMOLECULAR PUMP

Figure 1:
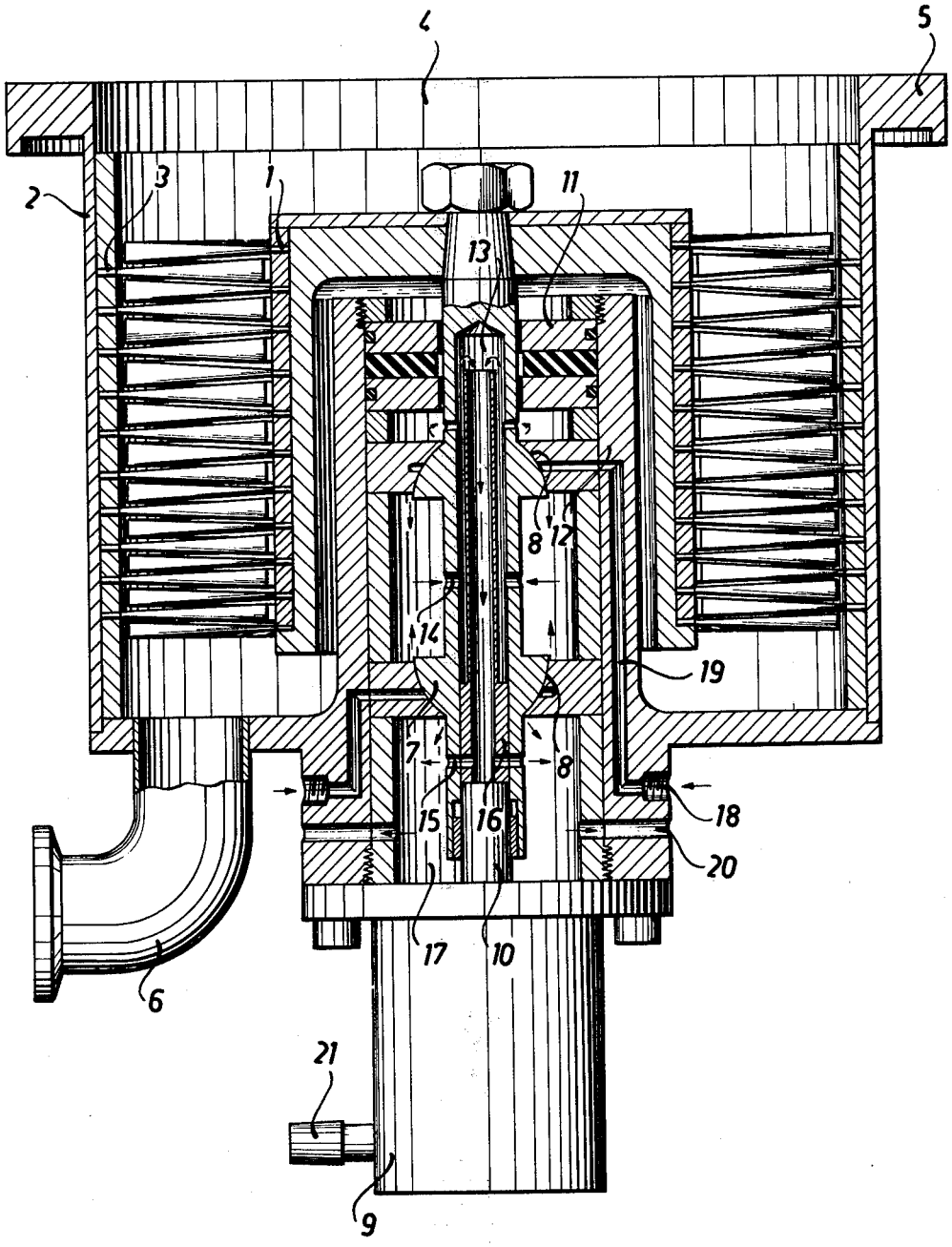

This is a continuation-in-part of co-pending application Ser. No. 669,264, Klatt et al. filed Mar. 22, 1976 (abandoned).

The present invention relates to a turbomolecular pump with a rotor shaft which is driven by a motor arranged outside the vacuum chamber and which carries the turbine rotor. By means of a pneumatic bearing that is sealed relative to the vacuum chamber, the rotor shaft is rotably arranged in the pump housing which houses the turbine stator of the turbomolecular pump.

Turbomolecular pumps are employed for generating low pressures of from about $10^{-3}$ to $10^{-9}$ Torr. Within this pressure range the mean free stroke length of the molecules is comparable with the dimensions of the turbine elements of the turbomolecular pump which move in opposite direction with regard to each other. The relative velocity between rotor and stator blades is for this reason selected very high which fact makes necessary the employment of rotary speeds of the rotor shaft within the range of some 10,000 rpm. The journalling of the rotor shaft is therefore of considerable importance. When driving and journalling turbomolecular pumps outside the vacuum chamber, it is furthermore necessary at the area where the rotor shaft passes through to provide a proper seal which corresponds to the pressure differential between the outer chamber and the high vacuum chamber. If for the journalling of the rotor shaft ball bearings or hydrostatic bearings are employed, care has to be taken that the lubricating vapors will be prevented from entering the high vacuum chamber. This danger always exists when the turbomolecular pump is turned off and, above all, at a non-intended switching off due to power failure. In order to prevent lubricating films from forming on the rotor and stator blades and on the wall surfaces of the connected recipients, which films will form when lubricating vapors enter the high vacuum chamber, it is known to equip the turbomolecular pump with automatic flooding devices (Fluteinrichtungen) which to be effective at any rate require a large number of parts and are therefore very expensive. A device of this type is disclosed, for instance, in German Offenlegungsschrift No. 2 034 327.

It is also known within the region of the bearings for the rotor shaft to provide condensation surfaces on which the oil vapors are supposed to condense before they can enter the high vacuum chamber. To prevent damage by lubricating oil in the vacuum chamber, it has furthermore been suggested to employ fluorinated oils as a lubricant. By means of all of the above mentioned known devices and steps the drawbacks caused by the evaporation of the lubricants have only partially and unsatisfactorily been eliminated.

A further drawback occurring when journalling the rotor shaft in oil lubricated ball bearings or hydrostatic bearings consists in that the bearings have to be cooled because of the high rotational speed of the rotor shaft. As cooling medium water is employed. For a hydrostatic pivot bearing it has become known to withdraw heat from the bearings by withdrawing oil. The cooling of the turbomolecular pump by means of water or oil increases the costs of operation of the pump and requires additional safety measures in case that the supply of water or oil should fail. A cooling by circulating oil increases the danger of soiling by lubricant vapors.

In an effort to remedy the above described difficulties, a pneumatic journalling of the turbomolecular pumps has been suggested. The sealing elements employed with this turbomolecular pump between the pneumatic bearing and the high vacuum chamber are, however, unable to prevent a drop of the generated high vacuum when the turbomolecular pump is turned off. This is very disadvantageous, above all, when the failure of the turbomolecular pump is caused by an operational disorder, and is in particular very disadvantageous for many methods which are carried out at a high vacuum, especially for methods carrying out heating processes, and results in a premature destruction of products produced in a high vacuum.

For driving turbomolecular pumps, electromotoric drives have proved very satisfactory. These drives, however, have the drawback that when connecting the turbomolecular pumps to installations equipped with electric measuring instruments, such as mass spectrometers, electric disturbances during the ascertainment of measured data can be avoided only at high costs.

It is, therefore, an object of the present invention to provide a turbomolecular pump with which a damage to the high vacuum chamber will be avoided, and with which a simple cooling without the employment of cooling water will be possible, and which will be substantially free from electrical sources of disturbances.

It is another object of this invention to provide a turbomolecular pump as set forth in the preceding paragraph which can be produced and operated at considerably lower costs than heretofore known turbomolecular pumps.

These and other objects and advantages of the invention will appear more clearly from the following specification in connection with the accompanying drawing diagrammatically illustrating a turbomolecular pump according to the invention.

The turbomolecular pump according to the present invention is characterized primarily in that as a drive motor there is employed a pressure gas turbine the output shaft of which is frictionally connected to the rotor shaft. The turbomolecular pump according to the invention is furthermore characterized in that duct insert means are inserted in the pump housing at that end of the rotor shaft which faces the vacuum chamber, the duct insert means being filled with a magnetic sealing fluid which is magnetically held in its position. The turbomolecular pump according to the invention is furthermore characterized in that at at least one of the gas outlets of the pneumatic bearing there are connected gas passages which are open toward the outside and which for purposes of cooling the duct insert means extend into the region of the duct insert means.

An advantageous further development of the invention consists in that as carrier liquid for the magnetic sealing liquid there is employed a liquid with low vapor pressure. As suitable carrier liquid a silicon oil commercially sold under the name of DC 705 has proved highly suitable. This silicon oil has an extremely low vapor pressure up to temperature of operation of about 50° C. Instead of silicon oil, also polyphenylether has proved suitable as carrier liquid.

When connecting the gas passages for cooling the duct insert means at at least one of the gas outlets of the pneumatic bearing, the gas passages can in a similar manner be designed by designing the rotor shaft as a hollow shaft closed toward the vacuum chamber; the hollow shaft establishing communication between the hollow chamber of the rotor shaft and the bearing chamber chamber of the pneumatic bearing. In this connection, at least a further bore is provided which establishes connection of the hollow chamber with the outside.

The turbomolecular pump according to the invention is advantageously suitable as gas collecting pump in connection with gas analyzing devices. Since the gases withdrawn by the turbomolecular pump will not be soiled when the vapors of the lubricant pass through the pump, and since due to the employment according to the invention of a gas-tight duct insert filed with a magnetic sealing liquid the gases are quantitavely not changed, it is possible truly to analyze the gas pressed by the turbomolecular pump into the prevacuum chamber.

IN THE DRAWINGS

Figure 2:
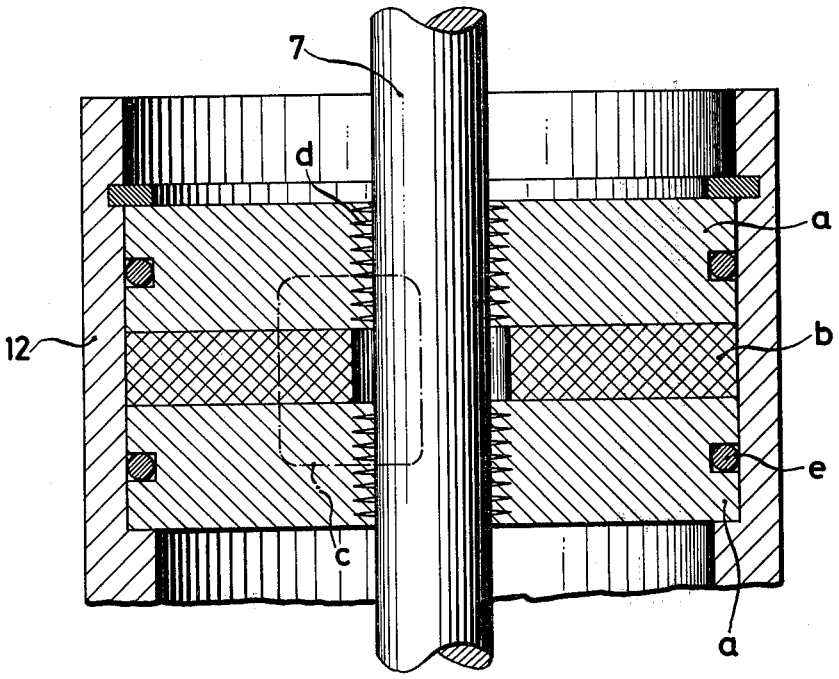

FIG. 1 provides a partially sectioned elevational view of a turbomolecular pump having features in accordance with the present invention. FIG. 2 is an enlarged sectional view of individual elements of a magnetic sealing duct insert having features in accordance with the present invention.

Referring now to FIG. 1 of the drawings in detail, it will be seen that the turbomolecular pump shown therein as an example comprises an inner turbine rotor 1 which for purposes of creating a suction effect is moved at high speed relative to the turbine stator 3 fixedly arranged in the pump housing 2. A flange 5 is connected to the suction side 4 of the turbomolecular pump for a gas-tight connection of a recipient. A pipe section 6 leads to the prevacuum chamber. The pipe section 6 is connected on the pump housing 2 to that end of the turbine rotor 1 which is located opposite to the suction side 4. By means of pneumatic bearings 8, a rotor shaft 7 carrying the turbine rotor 1 is outside the vacuum chamber V journalled in the pump housing 2. On the outside there is also provided the drive motor for the turbomolecular pump which motor in this instance is a pressure gas turbine 9. In the specific example illustrated in the drawing, the output shaft 10 of the pressure gas turbine 9 and the rotor shaft 7 of the turbomolecular pump are coupled to each other without the intervention of a transmission.

The pneumatic bearings 8 of the turbomolecular pump are sealed relative to the vacuum chamber by means of a duct insert 11 which is connected to a bearing housing 12 which is fixedly connected to the pump housing 2. The duct insert 11 is according to the present invention is replete with or plentifully supplied with a magnetic sealing liquid held magnetically in its respective position. The sealing effect of the duct insert 11 is based on the alternating effect between the magnetic sealing liquid and the permanent magnets arranged in the duct insert, while the magnetic return flow is effected through rotor shaft 7. The magnetic sealing liquid may consist of a suspension of ferromagnetic particles dispersed in a carrier liquid. As carrier liquid in the specific embodiment shown, advantageously silicon oil is employed, especially a silicon oil which is commercially available under the trade name DC 705. This silicon oil has an extremely low vapor pressure up to temperature of operation of about 50° C. so that, in contrast to the lubricants employed for lubricating the bearings, also during a standstill of the turbomolecular pump, no interferring or disturbing vapors will develop. Instead of silicon oil, polyvinylether may be used as carrier liquid.

For withdrawing the small quantity of heat developing in the duct insert 11, the gas withdrawn from the pneumatic bearing 8 is employed. To this end, the rotor shaft 7 is designed as a hollow shaft with a hollow chamber 13 which is closed toward the high vacuum chamber of the turbomolecular pump. The wall of the hollow shaft is provided with bores 14, 15 the bores 14 of which establish communication between the hollow chamber 13 of rotor shaft 7 and the hollow chamber of the pneumatic bearings 8. The hollow chamber 13 of the rotor shaft 7 extends into the range of the duct insert 11. A gas conduit 16 inserted into the hollow chamber 13 sees to it that the gas which through bores 14 flows from the bearing chamber of the pneumatic bearings 8 into a chamber 17 surrounding the pressure gas turbine 9, passes into the region of the duct insert 11 and exerts a cooling effect upon the rotor shaft 7. Due to the cooling of the duct insert 11 it will be assured that the temperature of operation will not exceed a maximum of 50° C. The gas is conveyed to the pneumatic bearing 8 through the gas connection 18 on the pump housing 2. The gas flows through gas passages 19 into the bearing chamber of the pneumatic bearing 8. The gas entering the chamber 17 is through openings 20 conveyed to the outside. In the specific embodiment shown, compressed air is used as gaseous medium for the pneumatic bearing. Compressed air also serves for driving the pressure gas turbine 9. For purposes of conveying compressed air, a gas connection 21 is provided on the pressure gas turbine 9. Instead of compressed air, also other gases, especially inert gases, may be employed with a similar effect.

When employing the turbomolecular pump as gas collecting pump on gas analyzing devices, the container or the recipient containing the gas to be analyzed is connected to the flange 5. The connection to the analyzing device communicates with the pipe section 6 on the pump housing 2.

As will be evident from the above, the advantage of the present invention consists in that by means of the duct insert filled with magnetic sealing liquid, a seal with extremely low leakage rate and therefore with a high sealing effect is realized even when the turbomolecular pump is at a standstill. The employment of a pressure gas turbine as drive motor advantageously affects not only the manufacturing costs and the costs of operation but is also highly advantageous due to the fact that with a turbomolecular pump according to the invention a single medium, namely gas, preferably air, is used for driving as well as for journalling and cooling purposes. This will assure that the turbomolecular pump together with the duct insert means will, without the necessity of employing special safety devices, not be liable to any disorders because in case of a failure in the gas supply, all operating media of the pump will fail simultaneously so that a destruction of parts of the turbomolecular pump will be avoided. In addition thereto, the pressure gas turbine will not create any disturbing or interferring electric fields, in contrast to electromotoric devices.

The present invention provides a specific arrangement of structure including the duct insert 11 and the hollow rotor shaft 7, as well as the magnetic sealing liquid, magnetic means associated therewith for retaining the sealing liquid in its sealing position. In the prior art more particularly, there is lacking any means for establishing communication between the pneumatic bearing means 8 and an area within the region of the duct insert means for cooling the duct insert means 11 by the gaseous medium from the pneumatic bearing means.

In FIG. 2, the individual elements of the magnetic sealing duct insert 11 are more clearly recognizable. Insert ducts of this type, however, are actually known (compare for example the disclosure of British Pat. No. 1,312,698). The contribution of the present invention is recognizable therein that this insert duct has been installed first of all with turbomolecular pumps in order to avoid damaging of a high vacuum chamber during standstill of the turbomolecular pump. Inventively, there is provided a fluid with low vapor pressure used as a carrier fluid for the magnetic particles of the magnetic sealing fluid in the insert duct and the insert duct 11 furthermore is cooled during the operation of the turbomolecular pump so that during utilization of such a fluid there is precluded an undesired heating of the duct insert 11 as a consequence of the high speed of the turbomolecular pump.

In order to distinguish the teaching of the present invention more clearly over the prior art, the distinctive features of a specific combination of the present invention over the prior art must be considered. The U.S. Pat. No. 3,399,827-Schwartzmann dated Sept. 3, 1968 discloses a turbomolecular pump though the dynamic seals 36, 38 provided therewith are effective only during operation of the turbomolecular pump and not during standstill of the pump so that with the reference an undesired air penetration is unavoidable into the high vacuum chamber upon the turning off of the turbomolecular pump. With the pneumatically journalled turbomolecular pump described by U.S. Pat. No. 3,969,042-Bachler dated July 13, 1976, there are no sealing elements provided which could preclude any air entry during standstill of the pump.

U.S. Pat. Nos. 3,753,623-Watz dated Aug. 21, 1973, and 3,969,039-Shoulders dated July 12, 1976, discloses ball-bearing or journalled turbomolecular pumps distinguishable from the teaching of the present invention. No sealing elements of the inventive type are installed in these turbomolecular pumps.

In order to clarify description and to facilitate understanding of the present invention, there is noted that the duct insert 11 can be designated as a sealing element in itself on the basis of the British Pat. No. 1,312,698. According to the present invention the insert duct 11 is provided for sealing the rotor shaft of a turbomolecular pump and is installed in the location of passage of the rotor shaft through the bearing housing into the vacuum chamber. The sealing effect of the duct insert 11 is attained by means of a sealing fluid which fills the remaining space between the insert duct 11 and the rotor shaft 7. As a sealing fluid there is used a colloidal of ferromagnetic particles (having a size or magnitude of 100A) in a carrier fluid which is held in position through generation of a magnetic field in the region of the suspension. The magnetic field is generated by permanent magnets which are inserted in the insert duct.

The duct insert 11 provides a ring or annular magnet b between two pole pieces a in FIG. 2 for generation of the magnetic field c. The return flow of the magnetic field occurs by way of the rotor shaft 7. Between the pole pieces a and the rotor shaft 7 there is provided the magnetic sealing fluid d . The seaing fluid d independent of the speed of the rotor shaft is held in position through the existing permanent magnetic field c. The insert duct 11 is installed vacuum tight in the bearing housing 12. The pole pieces a carrying sealing rings e. The bearing housing consists of a non-magnetic work material.

The seal of the rotor shaft of the turbomolecular pump relative to the high vacuum chamber and the rotatable guidance therewith can be considered further as follows. With the rotatable guidance embodiment, there is involved a previously known sealing element for machine parts which rotate at high speed. A suspension is used as the sealing means containing magnetic particles dispersed in a carrier fluid. The suspension is kept in its position by generation of a magnetic field. Experts are familiar with such rotational guidance means and references exist in which rotational guidance means of this type are described. Accordingly, the present U.S. disclosure sets forth sufficient detail for such a rotational guidance means for the present case has been called a sealing duct insert 11 (compare British Pat. No. 1,312,698).

The present invention concerns a pneumatically driven and pneumatically journalled turbomolecular pump, with which for sealing the rotor shaft as to the high vacuum chamber there is installed a duct insert means 11. With the present invention there is involved not only a combination of machine elements. Because of the high speed of the rotor shaft of the turbomolecular pump there could more particularly not be avoided a warming of the carrier fluid in the duct insert means without additional features so that there would have to be a vapor or steam development disturbing the high vacuum. According to the present invention this vapor or steam development which would be a disturbance for the high vacuum is avoided by cooling of the duct insert means whereby in an advantageous manner the gas escaping from the pneumatic bearing is utilized for this purpose. Such improvement features are not recognizable in the references.

The Schwartzman U.S. Pat. No. 3,399,827 issued Sept. 3, 1968 may have pump structure similar to that of the present disclosure, but the specific improvement of the cooling of the duct insert means by discharge gas from the pneumatic journalling cannot be found at all in this reference. Furthermore, the specific improvement of the present invention cannot be met by an attempted combining of three references including primarily Schwartzmann and alternately either Bachler-U.S. Pat. Nos. 3,469,042 dated July 13, 1976 or Wutz-3,753,633 dated Aug. 21, 1973. Either of the secondary references would also still lack specific improvement of the present invention to provide for cooling of the duct insert means by way of the discharge gas from the pneumatic journalling means.

It is, of course, to be understood that the present invention is, by no means, limited to the specific showing in the drawing but also comprises any modifications within the scope of the appended claims.

What is claimed is:

1. A high speed turbomolecular pump pneumatically driven and pneumatically journalled having a housing and a vacuum chamber, which includes in combination: a turbine stator stationarily arranged in said housing, a turbine rotor likewise arranged within said housing for cooperation with said turbine stator, a rotor shaft operable at rotary speeds within a range of approximately 10,000 rpm having said turbine rotor connected thereto for rotating said turbine rotor relative to said turbine stator, a pressure gas turbine having an output shaft drivingly connected to said rotor shaft for rotating the latter, said rotor shaft having one end portion located remote from its driving connection with said pressure gas turbine and in the vicinity of said vacuum chamber, pneumatic bearing means arranged in said pump housing and rotatably journalling said rotor shaft, duct insert means arranged vacuum tight in said pump housing and sealingly surrounding said end portion of said rotor shaft relative to said vacuum chamber and relative to said pneumatic bearing means, said duct insert means having filled thereagainst a magnetic sealing liquid with low vapor pressure, magnetic means associated with said magnetic sealing liquid for retaining the latter in its sealing position both during operation of the turbomolecular pump and also during standstill precluding entry of air into the vacuum chamber when the pump is off, and means establishing communication between said pneumatic bearing means and an area within the region of said duct insert means for cooling said duct insert means by the gaseous medium from said pneumatic bearing means.

2. A turbomolecular pump in combination according to claim 1, in which said magnetic sealing liquid includes a carrier liquid having a low vapor pressure up to about 50° C. with magnetic particles suspended therein.

3. A turbomolecular pump in combination according to claim 1, in which said rotor shaft is a shaft with an axial bore therein closed at that end of said rotor shaft which is remote from said pressure gas turbine, said rotor shaft being provided with first passage means establishing communication between said axial bore and said pneumatic bearing means and also being provided with second passage means establishing comunication between said axial bore and the outside of said pump.

4. A turbomolecular pump in combination according to claim 1, serving as a gas collecting pump, a container for receiving a gas to be analyzed and a gas analyzing device, said pump being arranged between said container and said gas analyzing device.

* * * * *